United States Patent [19]

Masui

[11] Patent Number: 4,581,914

[45] Date of Patent: Apr. 15, 1986

[54] ROLLING MILL

[75] Inventor: Takeshi Masui, Nishinomiya, Japan

[73] Assignee: Sumitomo Metal Industries, Ltd., Osaka, Japan

[21] Appl. No.: 746,015

[22] Filed: Jun. 19, 1985

Related U.S. Application Data

[63] Continuation of Ser. No. 450,272, Dec. 16, 1982, abandoned.

[51] Int. Cl.[4] ..... B21B 29/00; B21B 31/18; B21B 31/32

[52] U.S. Cl. ..... 72/242; 72/243; 72/245; 72/247; 72/16

[58] Field of Search ..... 72/242, 243, 247, 241, 72/245, 16

[56] References Cited

U.S. PATENT DOCUMENTS

| | | | |
|---|---|---|---|
| 3,478,559 | 11/1969 | Polakowski | 72/242 |
| 3,943,742 | 3/1976 | Kajiwara et al. | 72/247 |
| 4,218,905 | 8/1980 | Lehmann et al. | 72/245 |
| 4,270,377 | 6/1981 | Verbickas et al. | 72/242 |

FOREIGN PATENT DOCUMENTS

| | | | |
|---|---|---|---|
| 0110464 | 9/1976 | Japan | 72/245 |
| 0130307 | 10/1980 | Japan | 72/242 |
| 0030013 | 3/1981 | Japan | 72/241 |
| 0059518 | 5/1981 | Japan | 72/243 |
| 0158209 | 12/1981 | Japan | 72/241 |
| 0919987 | 2/1963 | United Kingdom | 72/243 |

*Primary Examiner*—Francis S. Husar
*Assistant Examiner*—Steve Katz
*Attorney, Agent, or Firm*—Burns, Doane, Swecker and Mathis

[57] ABSTRACT

A rolling mill having an upper set of rolls which has a work roll and a backup roll, and a lower set of rolls which has a work roll and a backup roll. Two parallel intermediate rolls are arranged between the work roll and the backup roll of either upper set or lower set or both sets, each of the intermediate rolls being supported by corresponding support rolls. The support rolls can be shifted toward and away from the corresponding intermediate rolls.

12 Claims, 17 Drawing Figures

ROLLING MILL

This application is a continuation, of application Ser. No. 450,272, filed 12/16/82 now abandoned.

BACKGROUND OF THE INVENTION

The present invention relates to a rolling mill.

In rolling steel strip, mill rolls are deflected due to a rolling pressure generated between the mill rolls and the rolled strip; such roll deflection must be compensated. In the practical rolling operation, various rolled materials of different dimension and/or different quality are rolled by the same rolling mill and various rolling pressures are generated accordingly, so that the mill rolls are deflected in various ways; the compensation for such roll deflections is very difficult.

Modern rolling mills are required to produce rolled material having improved cross-sectional profile and flatness. Heretofore, in order to achieve such requirements, the "roll initial crown" method and the "roll bending" method have both been used in combination in the rolling operation. However, even when these two methods are used, satisfactory results have not always been obtained, since the "roll initial crown" method requires frequent replacement of the rolls and the "roll bending" method limits the bending force due to less strength of the roll chock and/or roll neck.

One solution proposed to solve the above-mentioned problems has been to use a rolling mill comprising a six-stand rolling mill with the intermediate rolls offset in their axial directions to control the deflection of the work rolls. However, installation of such a rolling mill is expensive and it is difficult to control the camber of the rolled material since the intermediate rolls are arranged asymmetrically with respect to the mill line and, further, the rolls wear rapidly. Also, conversion from a conventional four-stand rolling mill to a six-stand rolling mill requires several to ten days down time during which production is stopped. This adds substantially to production costs.

As an alternative solution, a variable crown roll has been proposed. The variable crown roll (referred to as "VC roll" hereinafter) comprises, as shown in FIG. 1 of the drawings, an arbor 1, a sleeve 2 and an annular clearance or space 3 formed between the arbor and the sleeve. The height of crown of the VC roll (i.e., radial expansion of the roll) can be controlled by supplying a medium (such as water, oil, grease or the like) under high pressure from a medium pressurizing unit 4 to the space 3 through a conduit 5 formed in the arbor 1 and by adjusting the pressure of the medium by the unit 4.

Conventionally, the VC roll has mainly been used in place of the backup roll of a multi-stand rolling mill and it has the merit that it is easy to change the height of the crown of the roll during the rolling operation. However, when a rolling reduction higher than that obtained by the conventional rolling operation is required, in some cases, the roll deflection can not be compensated only by controlling the height of the crown of the VC roll.

Recently, to increase the rolling efficiency and quality, a rolling mill which can realize a higher rolling reduction has been desired, preferably, one having a wider range of compensation for the roll deflection, and one in which it is possible to compensate for roll wear and/or the thermal crown.

SUMMARY OF THE INVENTION

An object of the present invention is to provide, by simply modifying the existing rolling mill, a rolling mill capable of realizing a rolling reduction higher than that obtained by the conventional rolling mill thereby improving control over thickness of the rolled material.

In a preferred embodiment, to realize the higher rolling reduction, the rolling mill according to the present invention includes two parallel intermediate rolls arranged between a work roll and a backup roll of either upper set or lower set or both sets, each of the intermediate rolls being supported by corresponding support roll means, the support roll means being shiftable toward and away from the corresponding intermediate rolls. By adjusting the distance of shift of the support roll means, horizontal bend of each intermediate roll can be modified, thereby controlling the profile of the rolled material.

Preferably, the diameter of the work roll associated with the intermediate rolls is smaller than that of the other work roll. Since the smaller work roll deflects more than the conventional work roll under the same rolling pressure, this gives improved control of the profile of the rolled material.

Further, preferably, the support roll means comprise a plurality of support rolls coaxially aligned side by side, each of which can be independently shifted toward and away from the corresponding intermediate rolls.

Conventional roll benders can be used together with at least one of the work roll, the intermediate rolls and the backup roll. The backup roll may comprise the VC roll.

Further, in order to eliminate the localized wear of the rolls and to improve control of roll deflection, the upper and lower work rolls may be moved along their longitudinal axes.

By selecting appropriate combinations of the aforementioned modifications, the work roll can be variously deflected to give better control over the complex profile of the rolled material.

DETAILED DESCRIPTION OF THE PREFERRED EMBODIMENTS

Figure 2:
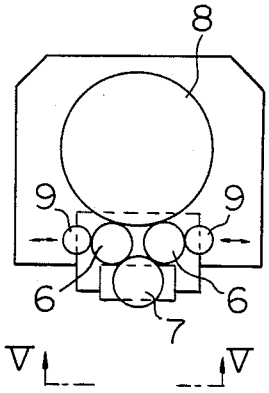
FIGS. 2 and 3 are side views of an upper half of the rolling mill according to the present invention.
Figure 3:
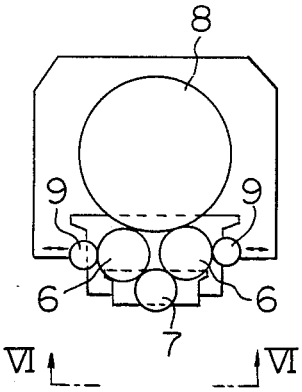

The present invention will now be described in detail with reference to the drawings showing embodiments of the rolling mill according to the present invention. As shown in FIGS. 2 and 3, a rolling mill according to the present invention comprises an upper set of rolls comprised of a work roll 7 and a backup roll 8, and a lower set of rolls comprised of a work roll 7 and a backup roll 8. According to the characteristic of the invention, two intermediate rolls 6 are positioned in parallel with each other and between the work roll 7 and the backup roll 8 of either upper set or lower set or both sets (for example, an upper set of rolls 7, 8 in FIGS. 2 and 3), these intermediate rolls being supported by support roll means 9. The support roll means 9 can be shifted in a horizontal direction (as shown by arrows in FIGS. 2 and 3) by forcing or shifting means 91 (FIG. 5) such as a hydraulic cylinder and the like. By adjusting the distance of shift of the support roll means 9, horizontal bend of the intermediate rolls can also be adjusted so that degree of deflection of the work rolls 7 is determined.

Figure 4:
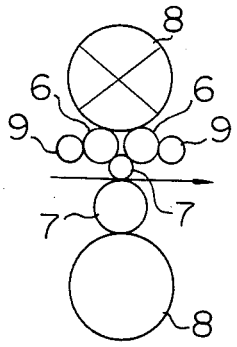
FIG. 4 is a side view of the rolling mill according to the present invention.
Figure 5:
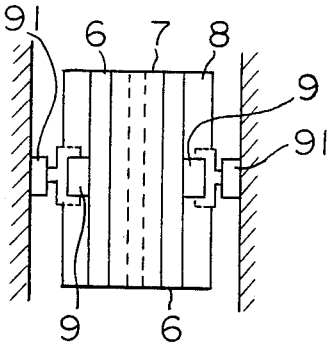
FIG. 5 is a bottom view taken along the line V—V of FIG. 2.
Figure 6:
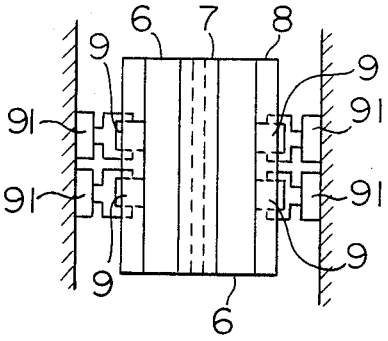
FIG. 6 is a bottom view taken along the line VI—VI of FIG. 3.

The upper and lower work rolls 7 may be of the same diameter, or, as shown in FIG. 4, the diameter of the work roll associated with the intermediate rolls 6 (i.e., the upper work roll) may be smaller than that of the lower work roll. The support roll means 9 may comprise a single roll as shown in FIG. 5, or may comprise a plurality of rolls as shown in FIG. 6. In FIG. 6, the support roll means are constituted by two rolls. In the latter case, each support roll 9 is shifted by the corresponding shifting means 91. A conventional roll bender (not shown) can be used together with the work rolls 7, the intermediate rolls 6 and/or the backup rolls 8.

Figure 1:
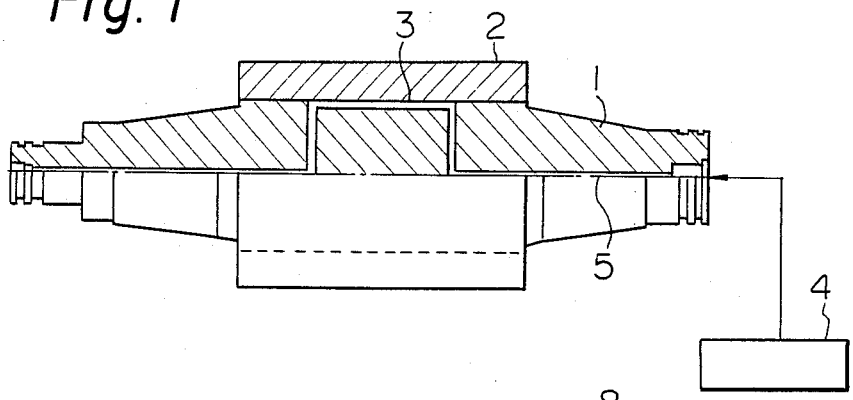
FIG. 1 is a longitudinal view of a VC roll used in a rolling mill according to the present invention, wherein an upper half of the roll is shown as a longitudinal sectional view.
Figure 7A:
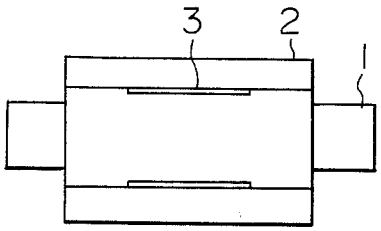
FIGS. 7(A)–7(D) are schematic longitudinal sectional views of modifications of the VC roll of FIG. 1.
Figure 7B:
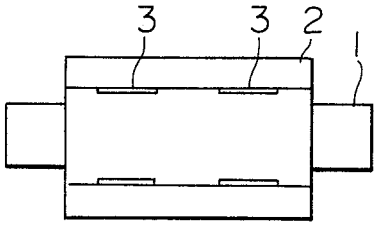
Figure 7C:
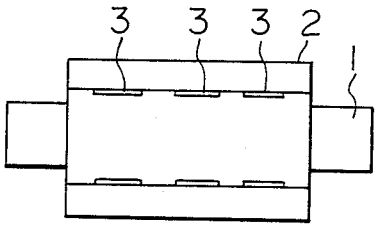
Figure 7D:
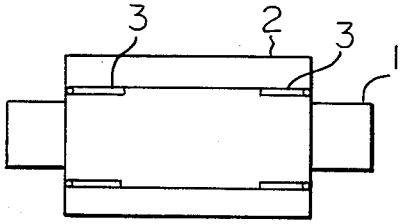

Advantageously, the backup roll 8 may be constituted by a VC roll (i.e., variable crown roll) as shown in FIG. 1. For example, as shown in FIG. 4, the upper backup roll 8 may comprise the VC roll (in the drawings, shown by symbol ⊗ ). Clearance or space 3 in the VC roll may comprise a single space (FIG. 7(A)), or may comprise a plurality of spaces (FIGS. 7(B)–7(D)).

Figures 8A, 8B, 8C:
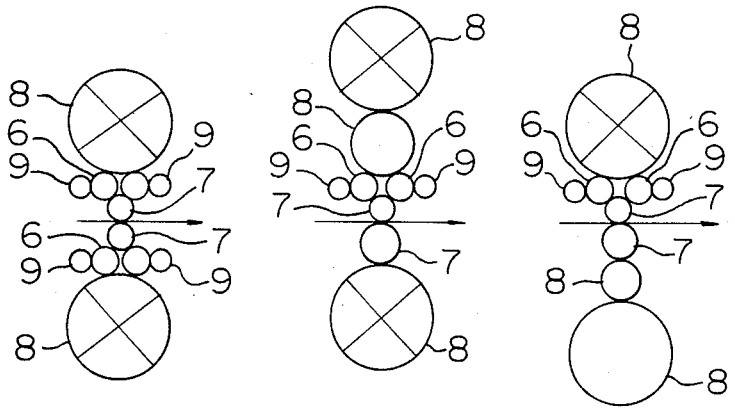
FIGS. 8(A)–8(C) are schematic side views showing modifications of the rolling mill according to the present invention.

Various combinations of the VC roll and the intermediate rolls can be realized; several examples of such combination are shown in FIGS. 8(A)–8(C). Ideally, the VC roll and the intermediate rolls should be arranged both in the upper half and the lower half of the rolling mill as shown in FIG. 8(A); however, by virtue of rolling requirements, even if these rolls are provided either in the upper half or in the lower half, the desired rolling results can be obtained. For example, as shown in FIG. 8(B), an additional intermediate backup roll (non VC roll) 8 may be provided between the upper backup roll 8 and the upper intermediate rolls 6, or as shown in FIG. 8(C), an additional backup roll (non VC roll) 8 may be provided between the work roll 7 and the backup roll 8 in the mill half where the intermediate rolls are not arranged (i.e., the lower half in the illustrated embodiment).

Figure 12:
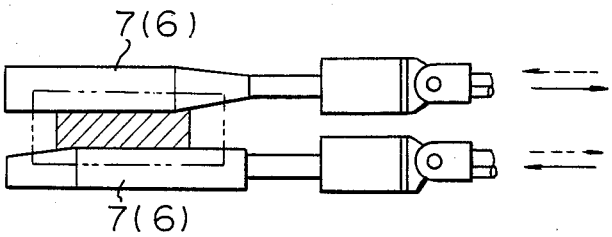
FIG. 12 is a schematic illustration of the construction of a shift mechanism for a work roll (or intermediate roll) of the rolling mill.

Further, it is known that, in hot rolling, limitation of "schedule" due to roll abrasion or roll wear reduces productivity in the rolling operation. In order to eliminate the localized wear of the rolls thereby permitting a "schedule-free" rolling operation, the upper and lower work rolls 7 or intermediate rolls 6 can be moved, preferably, along their longitudinal axes, as shown in FIG. 12. This also improves control of roll deflection. For example, in FIG. 12, each work roll 7 or intermediate roll 6 can be moved in either direction as shown by the arrows by means of appropriate shifting means such as a piston-cylinder.

Figure 9:
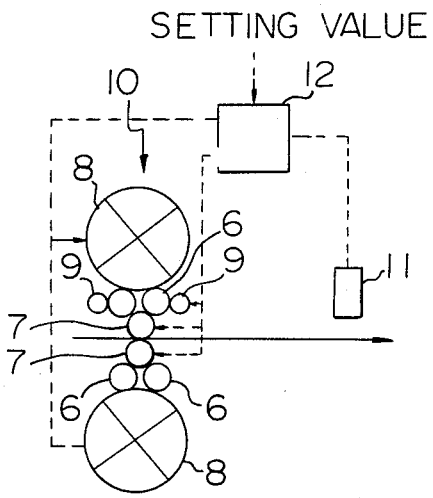
FIG. 9 is a schematic illustration showing a control system of the rolling mill according to the present invention.

FIG. 9 shows an embodiment of a control system for controlling the shape or profile of the rolled material. In this embodiment, a profile detector (and/or shape sensor) 11 is provided on the exit side of the rolling mill 10 according to the present invention. The profile detector and/or shape sensor can be provided on the entrance side of the mill or on both sides of the mill. The profile detector 11 detects the profile of the rolled material to generate a profile detecting signal which is in turn sent to a control unit 12 through a suitable line. The control unit 12 also receives a signal representative of a setting value and compares these two signals to generate a correction signal. This correction signal is supplied, respectively, to the shifting means 91 (FIG. 5) for the support roll means 9 and to a conventional medium pressurizing unit 4 (FIG. 1) for the VC roll acting as the backup roll 8, whereby the horizontal positions and the height of the crown of the rolls 9 and 8 are controlled. Further, the correction signal can be sent to an existing roll bender (not shown) for the work rolls 7 to improve the profile control effect.

Figure 10:
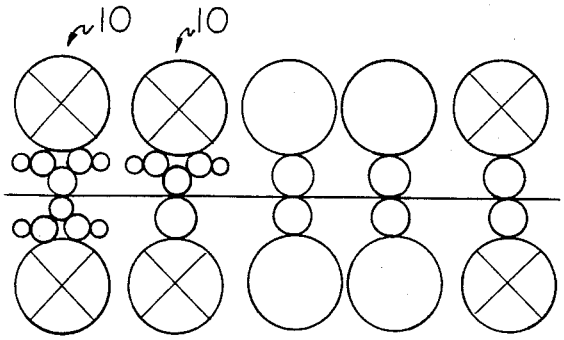
FIG. 10 is a schematic illustration showing an example of the construction of a continuous rolling mill utilizing the rolling mill according to the present invention.

FIG. 10 shows an example of a continuous rolling mill utilizing the rolling mill 10 of the present invention. As shown, the rolling mill 10 of the present invention can not necessarily be adopted to all of the stands of the continuous mill. In the illustrated embodiment, only the first and second stands comprise the rolling mill 10 of the present invention. Further, the construction of the respective rolling mills 10 constituting the stands of the continuous mill is not necessarily the same. The construction of each rolling mill constituting each stand of the continuous mill can be appropriately determined in accordance with the rolling requirements.

Now, experimental examples regarding the rolling mill according to the present invention will be described. It is herein to be noted that the following examples are presented as specific illustrations of the present invention. It should be understood that the invention is not limited to the specific details set forth in the examples.

EXAMPLE I (1) Rolling mill:

A rolling mill having the construction shown in FIG. 4 and FIG. 6 was used, although the upper and lower work rolls are of the same diameter.

| | | |
|---|---|---|
| Upper work roll: | Diameter | 80 mm |
| (Drive) | Length | 460 mm |
| Lower work roll: | Diameter | 80 mm |
| (Drive) | Length | 460 mm |
| Upper intermediate rolls: | Diameter | 50 mm |
| (X Two) | Length | 460 mm |
| Support rolls: | Diameter | 120 mm |
| (X Four) | Length | 150 mm |
| Upper backup roll: | Diameter | 200 mm |
| (VC roll) | Length | 460 mm |
| | Maximum oil pressure | 500 kg/cm$^2$ |

-continued

| | | |
|---|---|---|
| | Maximum expansion | 0.07 mm/radius |
| Lower backup roll: | Diameter | 200 mm |
| (non VC roll) | Length | 460 mm |

(2) Rolling:

Aluminum plate having a thickness of 4 mm and a width of 350 mm was rolled under load of 20 tons. During rolling, internal pressure of the VC roll (upper backup roll) and the distance of shift of the support rolls were adjusted.

Figure 11:
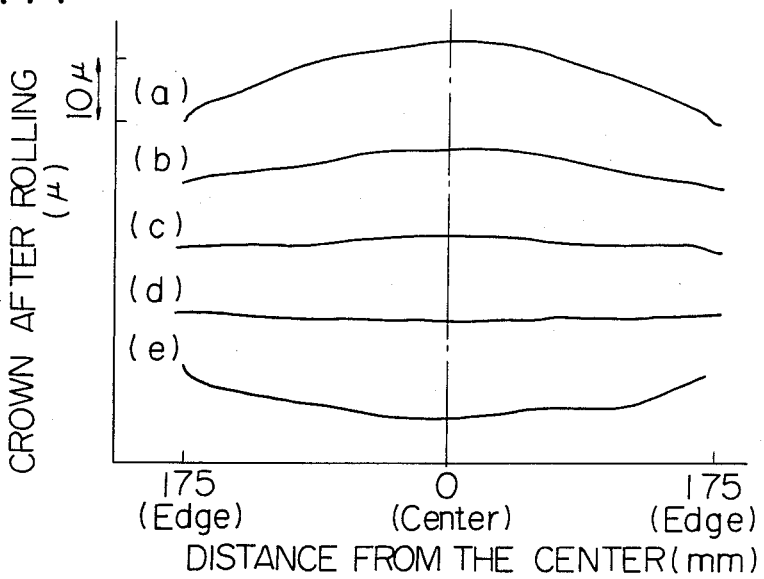
FIG. 11 is a graph showing thickness distribution of materials after rolling operation by means of the rolling mill according to the present invention.

(3) Result:

Thickness distribution of the aluminum plate after rolling operation is shown by curve (a) in FIG. 11. When the distance of the shift of the support rolls was larger than the reference value by 1.0 mm (i.e., when each of the support rolls was shifted inwardly from the reference position by 1.0 mm), the thickness distribution of the rolled aluminum plate was changed to curve (b) in FIG. 11. By comparing the curve (a) with the curve (b), the fact that the shift of the support roll contributes to compensation for the work roll deflection was ascertained.

EXAMPLE II

A rolling mill similar to that in Example I was used. However, in this Example II, a load of 2 tons was added to the roll bender for the work roll. Curve (c) in FIG. 11 shows the thickness distribution of the plate after rolling operation. From this result, it is clear that the work roll deflection was further reduced.

EXAMPLE III

A rolling mill similar to that in Example I was used. However, in this Example III, oil pressure in the VC roll was set to 500 kg/cm$^2$(maximum) and the expansion of the VC roll was set to 70 $\mu$/radius(maximum). Curve (d) in FIG. 11 shows the thickness distribution of the plate after rolling operation. From this curve (d), it is clear that the work roll deflection was completely counterbalanced and the central portion of the plate was made slightly thinner than the lateral portions thereof.

EXAMPLE IV

A rolling mill having the same construction as that in Example III was used. However, in this Example IV, the upper and lower work rolls were moved along their axes in opposite directions by 100 mm, respectively. Curve (e) in FIG. 11 shows the thickness distribution of the aluminum plate after rolling operation. As apparent from this curve (e), the central portion of the plate was considerably thinner than the end portions of the plate. This means that the rolling mill in this Example IV also has great ability for compensating the work roll deflection.

EXAMPLE V

A rolling mill similar to that in Example I was used. However, in this case, the upper work roll in the Example I (80 mm diameter) was replaced by an upper work roll having a diameter of 60 mm. The rolling operation in this Example was the same as that in Example I. As a result, it was ascertained that the bending effect of the intermediate rolls was substantially doubled and the effect of the VC roll increased by about 1.5 times.

EXAMPLE VI

The above Examples I–V show that the rolling mill according to the present invention provides effective control for the shape and/or profile of the rolled material. Here, a cold rolled steel strip having a thickness of 0.4 mm and a width of 300 mm was rolled with a rolling reduction of about 13% by using the following rolling mill. That is, the rolling mill used was the same type as that in Example I. The upper and lower work rolls had a diameter of 80 mm and the intermediate rolls were shifted inwardly by 1.0 mm. As a result, the steepness of the steel strip was changed by 4%. When the VC roll was used in either half of the mill, it was ascertained that the steepness of the steel strip was changed by 1.5%.

EXAMPLE VII

In the rolling operation similar to that in Example VI, the rolling mill having the upper work roll of 60 mm diameter and the lower work roll of 80 mm diameter was used and the intermediate rolls were shifted inwardly by 1.0 mm. As a result, the steepness of the steel strip was changed by 6.5%. When the VC roll was used in either half of the mill, the steepness was changed by 3%.

EXAMPLE VIII

The rolling mill used in Example VI was used. Further, in the rolling operation, a "decrease bending" was used in combination with an "intermediate roll bending". As a result, a complex undesirable shape or profile formed by both "center buckle" and "edge waves" was appeared on the rolled steel strip. From this fact, it is clear that a combined elongation can be controlled by the rolling mill according to the present invention.

EXAMPLE IX

The rolling mill used in Example I was used. However, in this Example IX, two parallel intermediate rolls were moved along their axes in opposite directions. As a result, the above mentioned strip shape in Example VIII changed from "edge waves" to "center buckle". This means that moving of two intermediate rolls in opposite directions is also effective to control work roll deflection.

Although the invention has been described with preferred embodiments, it is to be understood that variations and modifications may be employed without departing from the concept of the invention as defined in the following claims.

What is claimed is:

1. A rolling mill comprising an upper and a lower set of rolls, at least one of said sets comprising a work roll, a backup roll for receiving vertical forces imposed upon said set of rolls, two parallel intermediate rolls arranged between the work roll and the backup roll, at least one support roll adjacent each intermediate roll, said intermediate rolls and support rolls having axes lying substantially within a common horizontal plane, the backup roll having a diameter greater than a diameter of the support rolls, the diameter of the support rolls being less than a diameter of the intermediate rolls, and means operatively connected to said support rolls for controllably shifting each support roll horizontally toward and away from the respective intermediate roll to thereby adjust the horizontal bend of each intermediate roll.

2. A rolling mill as set forth in claim 1, wherein the at least one set is the upper set and the diameter of the work roll in the upper set is smaller than that of the work roll of the lower set.

3. A rolling mill as set forth in claim 1, wherein each support roll comprises a plurality of individual rolls coaxially aligned with one another, each of the individual rolls being independently shiftable toward and away from the corresponding intermediate roll.

4. A rolling mill as set forth in claim 1, wherein said rolling mill further comprises means operatively connected to the upper and lower work, rolls for moving the upper work roll and the lower work roll along their axes in opposite directions.

5. A rolling mill as set forth in claim 1, wherein said rolling mill further comprises means operatively connected to two parallel intermediate rolls for moving said two parallel intermediate rolls along their axes in opposite directions.

6. A rolling mill as set forth in claim 1, wherein each support roll is axially short in comparison to the corresponding intermediate roll and each support roll is positioned in proximity to the axial middle of the respective intermediate roll.

7. A rolling mill comprising an upper and a lower set of rolls, at least one of said sets comprising a work roll, a variable-crown backup roll for receiving vertical forces imposed upon said set of rolls, two parallel intermediate rolls arranged between the work roll and the backup roll, at least one support roll adjacent each intermediate roll; said intermediate rolls and support rolls having axes lying substantially within a common horizontal plane, the backup roll having a diameter greater than a diameter of the support rolls, the diameter of the support rolls being less than a diameter of the intermediate rolls, and means operatively connected to said support rolls for controllably shifting each support roll horizontally toward and away from the respective intermediate roll to thereby adjust the horizontal bend of each intermediate roll.

8. A rolling mill as set forth in claim 7, wherein the at least one set of rolls is the upper set and the diameter of the work roll in the upper set is smaller than that of the work roll of the lower set.

9. A rolling mill as set forth in claim 7, wherein each support roll comprises a plurality of individual rolls coaxially aligned with one another, each of the individual rolls being independently shiftable toward and away from the corresponding intermediate roll.

10. A rolling mill as set forth in claim 7, wherein said rolling mill further comprises means operatively connected to the upper and lower work rolls for moving the upper work roll and the lower work roll along their axes in opposite directions.

11. A rolling mill as set forth in claim 7, wherein said rolling mill further comprises means operatively connected to two parallel intermediate rolls for moving said two parallel intermediate rolls along their axes in opposite directions.

12. A rolling mill as set forth in claim 7, wherein each support roll is axially short in comparison to the corresponding intermediate roll and each support roll is positioned in proximity to the axial middle of the respective intermediate roll.

* * * * *